US009803260B2

(12) United States Patent
Zhou et al.

(10) Patent No.: US 9,803,260 B2
(45) Date of Patent: Oct. 31, 2017

(54) USE OF CATIONIC SURFACTANTS IN THE CYANIDATION OF REFRACTORY CARBONACEOUS ORES FOR RECOVERY OF METALS

(71) Applicant: Akzo Nobel Chemicals International B.V., Amersfoort (NL)

(72) Inventors: Qiong Zhou, Hopewell Junction, NY (US); Junhua Jiang, North Vancouver (CA); Yeonuk Choi, Toronto (CA)

(73) Assignee: AKZO NOBEL CHEMICALS INTERNATIONAL B.V., Arnhem (NL)

( * ) Notice: Subject to any disclaimer, the term of this patent is extended or adjusted under 35 U.S.C. 154(b) by 0 days.

(21) Appl. No.: 14/782,356

(22) PCT Filed: Apr. 17, 2014

(86) PCT No.: PCT/EP2014/057932

§ 371 (c)(1),
(2) Date: Oct. 5, 2015

(87) PCT Pub. No.: WO2014/170448

PCT Pub. Date: Oct. 23, 2014

(65) Prior Publication Data

US 2016/0024613 A1 Jan. 28, 2016

Related U.S. Application Data

(60) Provisional application No. 61/813,307, filed on Apr. 18, 2013.

(30) Foreign Application Priority Data

Jul. 4, 2013 (EP) ..... 13175107

(51) Int. Cl.

| | |
|---|---|
| ***C22B 1/00*** | (2006.01) |
| ***C22B 3/06*** | (2006.01) |
| ***C22B 11/08*** | (2006.01) |
| ***C22B 1/02*** | (2006.01) |
| ***C22B 3/16*** | (2006.01) |
| ***C22B 3/00*** | (2006.01) |

(52) U.S. Cl.

CPC ..... *C22B 11/08* (2013.01); *C22B 1/00* (2013.01); *C22B 1/02* (2013.01); *C22B 3/06* (2013.01); *C22B 3/16* (2013.01); *C22B 11/04* (2013.01)

(58) Field of Classification Search

CPC ..... C22B 3/06; C22B 1/00

See application file for complete search history.

(56) References Cited

U.S. PATENT DOCUMENTS

| | | | | |
|---|---|---|---|---|
| 1,519,396 | A | 12/1924 | Darrow | |
| 1,549,856 | A | 8/1925 | Darrow | |
| 2,234,140 | A | 3/1941 | Falconer et al. | |
| 4,754,953 | A * | 7/1988 | Brison | C01G 5/003 266/101 |
| 4,902,345 | A | 2/1990 | Ball et al. | |
| 5,061,459 | A * | 10/1991 | Bennett | C22B 11/08 423/29 |
| 5,336,474 | A | 8/1994 | Diehl et al. | |
| 5,358,699 | A | 10/1994 | Clough | |
| 5,612,431 | A | 3/1997 | Waddell et al. | |
| 5,744,063 | A * | 4/1998 | Desai | A61K 8/442 510/500 |
| 5,792,235 | A | 8/1998 | Kohr | |
| 5,827,348 | A | 10/1998 | Waddell et al. | |
| 2003/0228245 | A1 * | 12/2003 | Perez | C22B 3/04 423/29 |
| 2014/0348728 | A1 * | 11/2014 | Richardson | C22B 11/04 423/25 |

FOREIGN PATENT DOCUMENTS

| | | | |
|---|---|---|---|
| CN | 103122415 | A * | 5/2013 |
| GB | 515592 | * | 12/1939 |
| WO | 90/12119 | A1 | 10/1990 |
| WO | WO 2012174405 | A * | 12/2012 |

OTHER PUBLICATIONS

Bulatovic, Srdjan M., Handbook of Flotation Reagents: Chemistry, Theory and Practice: Flotation of Sulfidic Ores, vol. 1. Amsterdam, Elsevier, 2007. Chapters 1 and 2, pp. 1-41. Print. ISBN 04444530290.*

Jackson, Logan A. "Chapter 23: Applications of Cationic Polymers in Water Treatment." The Science and Technology of Industrial Water Treatment. CRC Press, 2010. Web. Jan. 10, 2017. pp. 465-479. Print ISBN: 978-1-4200-7144-3. eBook ISBN: 978-1-4200-7145-0. DOI: 10.1201/9781420071450-c23.*

European Search Report for EP 13175107.5, dated Nov. 13, 2013.

International Search Report and Written Opinion for PCT/EP2014/057932, dated Sep. 17, 2014.

G.M.K. Abotsi et al., Surface Chemistry of Carbonaceous Gold Ores, II. Effects of Organic Additives on Gold Adsorption from Cyanide Solution, International Journal of Mineral Processing, vol. 21, No. 3-4, Dec. 1, 1987, pp. 225-239, XP055072878.

K.S. Fraser et al., Processing of Refractory Gold Ores, Minerals Engineering, vol. 4, No. 7-11, Jan. 1, 1991, pp. 1029-1041, XP055086691.

K.L. Rees et al., Preg-Robbing Phenomena in the Cyanidation of Sulphide Gold Ores, Elsevier Science B.V., Hydrometallurgy 58 (2000), pp. 61-80.

* cited by examiner

*Primary Examiner* — George Wyszomierski
*Assistant Examiner* — Tima M McGuthry Banks
(74) *Attorney, Agent, or Firm* — Matthew J. DeRuyter

(57) ABSTRACT

A process for recovery of precious metals from ores or concentrates containing refractory carbonaceous material by cyanidation leaching. The process involves addition to the ores or concentrates at least one cationic surfactant before or during the addition of cyanide-containing solution. The agent enables the recovery of precious metals by cyanidation from high preg-robbing carbonaceous ores and improves the recovery of precious metals by cyanidation from medium to low preg-robbing carbonaceous ores. The agent also prevents froth and foaming formation during the cyanidation process.

14 Claims, No Drawings

USE OF CATIONIC SURFACTANTS IN THE CYANIDATION OF REFRACTORY CARBONACEOUS ORES FOR RECOVERY OF METALS

This application is a national stage filing under 35 U.S.C. §371 of PCT/EP2014/057932, filed Apr. 17, 2014, which claims priority to U.S. Provisional Patent Application No. 61/813,307 filed Apr. 18, 2013, and European Patent Application No. 13175107.5, filed Jul. 4, 2013, the contents of which are each incorporated herein by reference in their entireties.

BACKGROUND OF THE INVENTION

Leaching of precious metals from precious metal-containing ores or concentrates is a common commercial way for the production of precious metals. The cyanidation process is the current industry standard for leaching of precious metals. During cyanidation of precious metals, particularly gold, the metals are recovered from milled ores containing such metals by contacting with an alkaline cyanide-containing solution. With the formation of cyano complexes, precious metals are leached into solution for separation and later recovered by either electrowinning or zinc dust. In the case of gold, the dissolution of gold by cyanidation leaching can be represented as:

$$4Au+8NaCN+O_2+2H_2O \rightarrow 4Na[Au(CN)_2]+4NaOH$$

A large number of ores may, however, contain various amount of carbonaceous material, from 0.1% to up to 10%. Investigations on these kinds of ores suggested the carbonaceous materials are mostly naturally active carbon and long-chain hydrocarbons. Numerous studies indicated that presence of carbonaceous material in gold-bearing ores decreases the cyanidation leaching efficiency and the corresponding gold recovery. The interference of carbonaceous material with cyanide leaching may occur through formation of stable complexes by carbonaceous material with the gold or lock-up of gold within carbonaceous material, or adsorption of aurocyanide from cyanide leaching solution by the naturally active carbon on the ores; the latter is generally a more common problem with carbonaceous ores. When the interference occurs, some portion of the gold in the carbonaceous ores will not be available either for leaching and recovery from solution.

Roasting of carbonaceous ores at temperatures above 1000 F may effectively take away most of the detrimental effects of carbonaceous material on cyanidation leaching, however, performing such a step significantly increases energy cost and is faced with tight environmental regulations. Leaching of carbonaceous ores by thiosulfate has been suggested, in which carbonaceous material could have decreased interference with the leaching efficiency and the corresponding gold recovery.

Several ways to treat carbonaceous ores by different chemicals have been disclosed. For example, a process of using fatty acid salt for cyanidation of carbonaceous ores is known. Further, the cyanidation of carbonaceous ores using oleaginous substance and also an anionic soap substance is also known. Furthermore, the use of wetting agent of anionic sulfonate/sulfate, sulfosuccinate, and naphthalene sulfonate in the cyanidation of carbonaceous and non-carbonaceous ores has been suggested. A bioleaching process to recover precious metals from carbonaceous and non-carbonaceous ores after treatment of the ores with a plant-derived aromatic component has also been suggested.

A study has been done to examine the effects of surface active agents on gold (specifically gold cyanide) adsorption by (Ghana) carbonaceous gold ore, with pre-treating ores by surface active agents at pH 10. The examined surface active agents included: DDA (dodecylamine with alkyl chain of 12) and Aliquat 336 (tricaprylylmethylammonium chloride with alkyl chain length of 8 and 10). In the study, no cyanide leaching test was done. The report of the study indicated that gold uptake in aqueous cyanide solution is enhanced markedly by Aliquat 336 and slightly by DDA; this implied that detrimental effects of reduced gold recovery would occur if cyanide leaching test was ever done on the ore. In stark contrast, cyanide leaching results on carbonaceous gold ores of the present invention (as further shown below) show beneficial effects of increased gold recovery when the ores were pre-treated with cationic surface active agents having longer alkyl chain length, such as fatty amine and their derivatives with alkyl chain length from 14 to 40.

A method for treating copper-containing gold ores by surface active agents is also known. This method, however, concerns the presence of other metals in the gold ores which are liable to form cyanide salts, particularly copper (chalcopyrite). It is well-known that metallic minerals such as chalcopyrite or pyrite are preg-robbing (K. L. Rees et al., "Preg-robbing phenomena in the cyanidation of sulphide gold ores," Hydrometallurgy 58, 2000, pp. 61-80, stating that "chalcopyrite was shown to be very strongly preg-robbing. It competed with activated carbon to remove the majority of gold from solution. Pyrite was also strongly preg-robbing"). This known method for treating copper-containing gold ores was based on the finding that the deleterious effect of copper-containing minerals could be reduced by a form of passivation pre-treatment during or prior to cyanidation. The copper was not removed but passed through the cyanidation process with a reduced tendency to form cyanide complexes.

Hence, there is still a need for a method of treating carbonaceous material containing precious metal ores or concentrates which provides increased recovery of the precious metal.

SUMMARY OF THE INVENTION

It has been unexpectedly discovered that treating carbonaceous material containing precious metal ores or concentrates, particularly gold ores from which the precious metal is to be leached and recovered by cyanidation, reduces and/or prevents the deteriorative effects of gold or aurocyanide complex retention to the ores by carbonaceous material of the ore during cyanidation, as well as increases the recovery of the precious metal by cyanidation.

It is therefore an object of this invention to provide an economical and effective process for improvement on recovering gold and other precious metals from refractory carbonaceous ores or concentrates with cyanidation leaching, by treating carbonaceous material containing precious metal ores or concentrates, particularly gold ores with a cationic surfactant or mixture containing cationic surfactant. For high preg-robbing carbonaceous ores, which will typically yield less than 10% gold recovery without the treatment, the added surfactant enables more than 60% gold recovery by cyanidation at same leaching conditions. For medium to low preg-robbing carbonaceous ores, which could typically yield gold recovery of 40~80% without the treatment, the added surfactant improves the gold recovery by another 5-30% by cyanidation at same leaching conditions. The treatment of precious metal containing carbonaceous ores by the surfactant is a simple drop-in of the surfactant to carbonaceous ores, preferably into aqueous ore slurry of the carbonaceous ores. No essential changes in the cyanidation process are needed as a result of the addition of the surfactant to carbonaceous ores.

DESCRIPTION OF THE INVENTION

The present invention is directed to a method for recovering a metal from ore or concentrate containing carbonaceous material by cyanidation leaching. The process comprises the step of treating the ore or concentrate with at least one cationic surfactant, and cyanidation leaching of the treated ore or concentrate. To initiate the leaching, a cyanide-containing solution may be added to the ore or concentrate. The addition of the cyanide-containing solution may be done simultaneously with or after the treating step. The treating step is initiated by adding the at least one cationic surfactant to the ore or concentrate. Additionally, the ore or concentrate may be roasted before being treated with the cationic surfactant.

The method of the present invention is suitable for the recovery of a metal from its ore or concentrate; examples of such metal include, but are not limited to, gold, silver, and platinum group metals. Platinum group metals include, but not limited to, platinum, palladium, rhodium, iridium, ruthenium, and osmium.

In one embodiment, the ore or concentrate may be in the form of an aqueous ore slurry with particle size 80% passing 30 mesh and a pulp density of 5% to 80%. In another embodiment, the aqueous ore slurry has a particle size 80% passing 100 mesh; in yet another embodiment, 80% passing 200 mesh. Also, in one embodiment, the aqueous ore slurry has a pulp density of 20% to 50%; in another embodiment, 15% to 65%.

The method of the present invention may include the step of oxidizing the ore or concentrate prior to the treating step. This oxidizing step may be particularly useful when the ore or concentrate is in the form of an aqueous ore slurry. The oxidizing step may be done by pressure oxidation, chlorine oxidation, peroxide oxidation or bacteria biodegradation.

The ore or concentrate may be treated with the cationic surfactant with agitation for a period of 1 minute to 10 hours; such agitation is done after the addition of the cationic surfactant to the ore or concentrate. In one embodiment, the ore or concentrate is treated with the cationic surfactant for a period of 10 minutes to 2 hours; in another embodiment, 20 minutes to 1 hour. The ore or concentrate may also be treated with the cationic surfactant at a temperature of 10° C. to 100° C. Heating may be needed to bring up the temperature of the ore or concentrate (slurry) to the desired temperature. In one embodiment, the ore or concentrate is treated with the cationic surfactant at a temperature of 10° C. to 50° C.; in another embodiment, 15° C. to 30° C.; in yet another embodiment, 50° C. to 95° C.; and in one other embodiment, 60° C. to 90° C. The treatment of the ore or concentrate may be carried out in an acidic or basic condition. In one embodiment, the ore or concentrate is treated in a condition of pH 0-7; in another embodiment pH 1-5; in yet another embodiment pH 1-4.

The amount of the at least one cationic surfactant used to treat the ore or concentrate is in the range of 0.01 kg/ton (0.01 kg of surfactant to a ton of ore or concentrate) to 20 kg/ton basis of the ore or concentrate. In one embodiment, the amount is in the range of 0.1 kg/ton to 5 kg/ton; in another embodiment, 0.2 kg/ton to 2 kg/ton.

The cyanidation leaching suitable for the present method includes carbon-in-leach (CIL) cyanidation, carbon-in-pulp (CIP) cyanidation, resin-in-leach (RIL) cyanidation and direct cyanidation. Preferably, the cyanidation is performed at a basic condition, e.g., pH 8-13, 9-12, or 10-11; this may be done by adjusting the pH prior to the addition of the cyanide-containing solution.

A large number of ore bodies and large amount of carbonaceous ores are suitable to be treated in accordance with the present invention. The carbonaceous ore may be very high preg-robbing by itself, the carbonaceous ore may show low to medium preg-robbing nature. The carbonaceous ore may contain oxidized ore material, such as copper oxide or iron oxide. Also, the carbonaceous ore may contain metal sulfide, such as iron sulfide (pyrite, arsenopyrite, realgar, etc.) or copper sulfide (chalcopyrite, chalcocite, enargite, etc.). These sulfides, if present, may be removed by pressure oxidation, bio-oxidation or roasting.

Preg-robbing is understood to be the phenomenon where the gold cyanide complex is removed from leaching solution by the constituents of the ores. In other words, gold is leached out by cyanide from ores and simultaneously the formed gold cyanide complex is adsorbed back to the ores by its native components, and this will make the gold unavailable for recovery at later steps.

The cationic surfactant suitable for use in the present invention includes alkyl amine and derivatives thereof, alkyl amide, amidoamine, and imidazoline. The alkyl amine may be a primary, secondary, or tertiary alkyl amine or alkyl polyamine. The alkyl amine has an alkyl chain length of about 4 to about 40. In one embodiment, the alkyl amine has an alkyl chain length of about 6 to about 32; in another embodiment, about 8 to about 28; and in yet another embodiment, about 10 to about 24. In a preferred embodiment, the alkyl amine has an alkyl chain length of about 14 to about 40, in another embodiment, about 16 to about 32, in yet another embodiment, about 16 to about 22. The alkyl amine may be animal based or vegetable based fatty alkyl amine. In one embodiment, the alkyl amine is derived from animal based fat or vegetable oil. In another embodiment, the alkyl amine is derived from coconut, castor, tallow, tall oil, soyabean, palm, corn, or rapeseed. The alkyl amine may be alkoxylated (e.g., ethoxylated or propoxylated or both ethoxylated and propoxylated).

The cationic surfactant may also be a salt of the alkyl amine or the alkyl amine derivative. Suitable salts include acetate, sulfate, phosphate, chloride, bromide, and nitrate. The cationic surfactant may also be an alkyl quaternary ammonium salt; examples thereof include, but are not limited to tallowalkyl trimethyl ammonium chloride and N,N,N',N',N'-pentamethyl-N-tallow-1,3-propane diammonium dichloride. The cationic surfactant may also be an alkoxylated (e.g., ethoxylated or propoxylated or both ethoxylated and propoxylated) alkyl quaternary ammonium salt; examples thereof include, but are not limited to, tris(2-hydroxyethyl) tallowalkyl ammonium acetate, cocoalkylmethyl ethoxylated (2) ammonium chloride. The cationic surfactant may also be an alkyl amine oxide (alkoxylated or unalkoxylated); examples thereof include, but are not limited to bis(2-hydroxyethyl)-cocoalkylamine oxide, dimethylhydrogenated tallowalkylamine oxide.

In one particular embodiment, the cationic surfactant is an ethoxylated alkylamine derived from tallow. In another particular embodiment, the cationic surfactant is a propoxylated alkylamine derived from tallow.

The amidoamine may be a primary, secondary, or tertiary amidoamine or amidopolyamine. The alkyl amide, amidoamide or imidazoline suitable for use as the cationic surfactant in the method of the present invention has an alkyl chain length of about 4 to about 40. In one embodiment, the alkyl amide, amidoamide or imidazoline has an alkyl chain length of about 6 to about 32; in another embodiment, about 8 to about 28; and in yet another embodiment, about 10 to about 24. In a preferred embodiment, the alkyl amine has an alkyl chain length of about 14 to about 40, in another embodiment, about 16 to about 32, in yet another embodiment, about 16 to about 22. The alkyl amide, amidoamide or imidazoline may be animal based or vegetable based fatty alkyl amine. In one embodiment, the alkyl amide, amidoamide or imidazoline is derived from animal based fat or vegetable oil. In another embodiment, the alkyl amide, amidoamide or imidazoline is derived from coconut, castor, tallow, tall oil, soyabean, palm, corn, or rapeseed.

It is understood that the cationic surfactant may be a combination of a cationic surfactant with at least one other surfactant, such as a different cationic surfactant, an anionic surfactant (e.g., sodium lauryl ether sulfate), a non-ionic surfactant (e.g., C10-12 alcohol ethoxylate), and amphoteric surfactant (e.g., N-tallowalkyl betaine). If the cationic surfactant is a mixture of surfactants, the amount of the surfactant mixture used to treat the ore or concentrate is in the range of 0.01 kg/ton (0.01 kg of surfactant to a ton of ore or concentrate) to 20 kg/ton basis of the ore or concentrate. In one embodiment, the amount is in the range of 0.1 kg/ton to 5 kg/ton; in another embodiment, 0.2 kg/ton to 2 kg/ton.

Depending on the cationic surfactant used in the treatment of the ore or concentrate, formation of large amount of foaming or froth during the leaching process may occur. As such, the method according to the present invention may further comprise the step of adding a defoamer to the ore or concentrate prior to the step of cyanidation leaching. Examples of a suitable defoamer include, but are not limited to, oils (or dispersion thereof), waxes (or dispersions thereof), ethyleneoxide (EO) or propyleneoxide (PO) polymers, and silicone-based dispersions or emulsions.

The present inventors have also unexpectedly discovered that while some of the surfactants used to treat the ore or concentrate may result in the formation of large amount of foaming or froth during the leaching process caused by the movement of the ores and/or the intentional introduction or in-situ generation of air/oxygen during the leaching (particularly when the carbonaceous ores are in the form of aqueous slurry with fine particle size of less than 300 microns), others do not. Particularly, it has been unexpectedly discovered that while the treatment of the ore or concentrate with an ethoxylated alkylamine derived from tallow may cause a large amount of foaming or froth, the same treatment with a propoxylated alkylamine derived from tallow does not. This discovery may lead to a more efficient recovery method in which no defoamer is necessary.

The present invention will now be illustrated by the following non-limiting examples.

EXAMPLES

Example 1

A sample of carbonaceous gold ore with approximately 0.10 oz/ton of gold was used for cyanidation leaching. The ore was a double refractory ore containing approximately 0.6% organic carbon and showed medium preg-robbing, it was obtained as acidic discharge slurry from autoclave after pressurized oxidation (POX) with a particle size of 80% passing 150 microns and pulp density up to 50%. Additional water was used to reduce pulp density to 30~40% wt solids, and the resulting slurry was used for further treatments by surfactant and corresponding carbon-in-leach (CIL) cyanidation leaching. A stainless steel tank with this ore slurry was heated to 90° C. in a water bath. Surfactant was added to the heated slurry and the slurry was conditioned for 1 hour at 90° C. and at the pH as-is. Then, the conditioned slurry was transferred to a bottle, and the pH of the slurry was adjusted, if needed, to pH 10~11.5 using lime. Sodium cyanide of approximately 1 g/L and activated carbon of approximately 20 g/L were added, and the bottle was rotated on a roller for 20 hrs. The pulp was then filtered and washed for gold analysis. The percentage gold recovery is calculated from assayed head gold and residue gold. An example where the slurry was not treated by any agent was carried out the same way, and the gold recovery was measured through same CIL cyanidation leaching process. Table 1 shows the leaching results after ore was conditioned with different surfactants used at various dosages.

TABLE 1

| Surfactant used | Surfactant dosage added (kg/t) | Gold Recovery (%) |
|---|---|---|
| none | 0 | 51.7 |
| Armac HT (hydrogenated tallow alkylamine acetate) | 0.5 | 72.7 |
| Armac HT | 1.0 | 77.7 |
| Armac HT | 2.0 | 78.3 |
| Armac HT | 5.0 | 80.0 |
| Ethomeen T/12 (ethoxylated alkylamine derived from tallow) | 0.5 | 75.0 |
| Ethomeen T/12 | 1.0 | 76.0 |
| Ethomeen T/12 | 2.0 | 77.3 |
| Ethomeen T/12 | 5.0 | 74.3 |
| Armeen HT (hydrogenated tallow alkylamine) | 0.5 | 75.0 |
| Armeen HT | 1.0 | 75.7 |
| Armeen HT | 2.0 | 76.7 |
| Armeen HT | 5.0 | 79.0 |

Example 2

A sample of the same ore and its acidic POX autoclave discharge slurry as in example 1 was used for cyanidation leaching. Additional water was used to reduce the pulp density of the slurry to 30~40% wt solids, and the resulting slurry was used for further treatments by surfactant and corresponding carbon-in-leach cyanidation leaching. A stainless steel tank with this ore slurry was heated to 90° C. in a water bath. Surfactant was added to the heated slurry and the slurry was conditioned at 90° C. and at the pH as-is for a period of 20 to 60 minutes. Then, the conditioned slurry was transferred to a bottle, and the pH of the slurry was adjusted, if needed, to pH 10~11.5 using lime. Sodium cyanide of approximately 1 g/L and activated carbon of approximately 20 g/L were added, and the bottle was rotated on a roller for 20 hrs. The pulp was then filtered and washed for gold analysis. The percentage gold recovery is calculated from assayed head gold and residue gold. An example where the slurry was not treated by any agent was carried out the same way, and the gold recovery was measured through same CIL cyanidation leaching process. Table 2 shows the leaching results after ore was conditioned with surfactant for different period of time.

TABLE 2

| Surfactant used | Surfactant dosage added (kg/t) | conditioning time (min) | Gold Recovery (%) |
|---|---|---|---|
| none | 0 | 60 | 51.7 |
| Armac HT | 2 | 60 | 78.3 |
| Armac HT | 2 | 50 | 79.0 |
| Armac HT | 2 | 40 | 80.0 |
| Armac HT | 2 | 30 | 79.0 |
| Armac HT | 2 | 20 | 79.0 |
| Ethomeen T/12 | 0.5 | 60 | 75.0 |
| Ethomeen T/12 | 1.0 | 60 | 76.0 |
| Ethomeen T/12 | 0.5 | 30 | 79.3 |
| Ethomeen T/12 | 1.0 | 30 | 77.7 |

Example 3

A sample of the same ore and its acidic POX autoclave discharge slurry as in example 1 was used for cyanidation leaching. Additional water was used to reduce the pulp density of the slurry to 30~40% wt solids, and the resulting slurry was used for further treatments by surfactant and corresponding carbon-in-leach cyanidation leaching. A stainless steel tank with this ore slurry was heated in a water bath. Surfactant was added to the heated slurry and the slurry was conditioned for 30 minutes at the pH as-is and at different temperatures from 20° C. to 90° C. Then, the conditioned slurry was transferred to a bottle, and the pH of the slurry was adjusted, if needed, to pH 10~11.5 using lime. Sodium cyanide of approximately 1 g/L and activated carbon of approximately 20 g/L were added, and the bottle was rotated on a roller for 20 hrs. The pulp was then filtered and washed for gold analysis. The percentage gold recovery is calculated from assayed head gold and residue gold. An example where the slurry was not treated by any agent was carried out the same way, and the gold recovery was measured through same CIL cyanidation leaching process. Table 3 shows the leaching results after ore was conditioned with surfactant at different condition temperatures.

TABLE 3

| Surfactant used | Surfactant dosage added (kg/t) | conditioning temperature (° C.) | Gold Recovery (%) |
|---|---|---|---|
| none | 0 | 90 | 51.7 |
| Ethomeen T/12 | 1 | 20 | 70.0 |
| Ethomeen T/12 | 1 | 40 | 72.3 |
| Ethomeen T/12 | 1 | 65 | 76.0 |
| Ethomeen T/12 | 1 | 80 | 76.0 |
| Ethomeen T/12 | 1 | 90 | 77.7 |

Example 4

A sample of carbonaceous gold ore with approximately 0.23 oz/ton of gold was used for cyanidation leaching. The ore was a double refractory ore containing approximately 4.4% total carbon with 0.7% organic carbon and showed very high preg-robbing, it was obtained as alkaline discharge slurry after pressurized oxidation with a particle size of 80% passing 100 microns and pulp density up to 50%. Additional water was used to reduce pulp density to 30~40% wt solids, and the resulting slurry was used for further treatments by surfactant and corresponding carbon-in-leach cyanidation leaching. A stainless steel tank with this ore slurry was heated to 90° C. in a water bath. Surfactant was added to the heated slurry and the slurry was conditioned for 1 hour at 90° C. and at the pH as-is. Then, the conditioned slurry was transferred to a bottle, and the pH of the slurry was adjusted, if needed, to pH 10~11.5 using lime. Sodium cyanide of approximately 1 g/L and activated carbon of approximately 20 g/L were added, and the bottle was rotated on a roller for 20 hrs. The pulp was then filtered and washed for gold analysis. The percentage gold recovery is calculated from assayed head gold and residue gold. An example where the slurry was not treated by any agent was carried out the same way, and the gold recovery was measured through same CIL cyanidation leaching process. Table 4 shows the leaching results after the ore was conditioned with surfactant.

TABLE 4

| Surfactant used | Surfactant dosage added (kg/t) | conditioning temperature (° C.) | Gold Recovery (%) |
|---|---|---|---|
| none | 0 | 90 | 7.6 |
| Ethomeen T/12 | 1 | 90 | 46.5 |

Example 5

A sample of carbonaceous gold ore with approximately 0.11 oz/ton of gold was used for cyanidation leaching. The ore was a double refractory ore containing approximately 1.45% organic carbon and showed very high preg-robbing, it was obtained as acidic discharge slurry from autoclave after pressurized oxidation with a particle size of 80% passing 100 microns and pulp density up to 50%. Additional water was used to reduce pulp density to 30~40% wt solids, and the resulting slurry was used for further treatments by surfactant and corresponding carbon-in-leach cyanidation leaching. A stainless steel tank with this ore slurry was heated to 80~90° C. in a water bath. Surfactant was added to the heated slurry and the slurry was conditioned for 30 minutes at 80~90° C. and at the pH as-is. Then, the conditioned slurry was transferred to a bottle, and the pH of the slurry was adjusted, if needed, to pH 10~11.5 using lime. Sodium cyanide of approximately 1 g/L and activated carbon of approximately 20 g/L were added, and the bottle was rotated on a roller for 20 hrs. The pulp was then filtered and washed for gold analysis. The percentage gold recovery is calculated from assayed head gold and residue gold. An example where the slurry was not treated by any agent was carried out the same way, and the gold recovery was measured through same CIL cyanidation leaching process. Table 5 shows the leaching results after the ore was conditioned with surfactant at various dosages.

TABLE 5

| Surfactant used | Surfactant dosage added (kg/t) | conditioning temperature (° C.) | Gold Recovery (%) |
|---|---|---|---|
| none | 0 | 90 | 9.3 |
| Ethomeen T/12 | 0.1 | 90 | 32.6 |
| Ethomeen T/12 | 0.25 | 90 | 50.2 |
| Ethomeen T/12 | 0.5 | 90 | 55.0 |
| Ethomeen T/12 | 1 | 80 | 62.3 |
| Ethomeen T/12 | 2 | 80 | 59.7 |
| Ethomeen T/12 | 5 | 80 | 60.7 |

Example 6

A sample of carbonaceous gold ore with approximately 0.21 oz/ton of gold was used for cyanidation leaching. It was obtained from the 1st stage of roaster with a particle size of 80% passing 100 microns. The ore contains 0.88% organic carbon and showed medium preg-robbing after roasting at a much higher throughput. Water was used to adjust pulp density to 30~40% wt solids, and the resulting slurry was used for further treatments by surfactant and corresponding carbon-in-leach cyanidation leaching. A stainless steel tank with this ore slurry was heated to 80° C. in a water bath. Surfactant was added to the heated slurry and the slurry was conditioned for 30 minutes at 80° C. and at the pH as-is. Then, the conditioned slurry was transferred to a bottle, and the pH of the slurry was adjusted, if needed, to pH 10~11.5 using lime. Sodium cyanide of approximately 1 g/L and activated carbon of approximately 20 g/L were added, and the bottle was rotated on a roller for 20 hrs. The pulp was then filtered and washed for gold analysis. The percentage gold recovery is calculated from assayed head gold and residue gold. An example where the slurry was not treated by any agent was carried out the same way, and the gold recovery was measured through same CIL cyanidation leaching process. Table 6 shows the leaching results after the ore was conditioned with surfactant.

TABLE 6

| Surfactant used | Surfactant dosage added (kg/t) | Activated carbon used in CIL leaching | Gold Recovery (%) |
|---|---|---|---|
| none | 0 | carbon 1 | 71.9 |
| Ethomeen T/12 | 1.0 | carbon 1 | 82.7 |
| Ethomeen T/12 | 1.0 | carbon 2 | 81.6 |
| Propomeen T/12 (propoxylated alkylamine derived from tallow) | 1.0 | carbon 1 | 80.6 |
| Propomeen T/12 | 1.0 | carbon 2 | 78.9 |

Example 7

A sample of carbonaceous gold ore with approximately 0.10 oz/ton of gold was used for cyanidation leaching. The ore was crushed and ground to powder form with a particle size of 80% passing 75 microns. Water was added into powder to give a pulp density of 30~40% wt solids, and the resulting slurry was used for further treatments by surfactant and corresponding carbon-in-leach cyanidation leaching. A stainless steel tank with this ore slurry was heated to 80° C. in a water bath. Surfactant was added to the heated slurry and the slurry was conditioned for 30 minutes at 80° C. and at the pH as-is. Then, the conditioned slurry was transferred to a bottle, and the pH of the slurry was adjusted, if needed, to pH 10~11.5 using lime. Sodium cyanide of approximately 1 g/L and activated carbon of approximately 20 g/L were added, and the bottle was rotated on a roller for 20 hrs. The pulp was then filtered and washed for gold analysis. The percentage gold recovery is calculated from assayed head gold and residue gold. An example where the slurry was not treated by any agent was carried out the same way, and the gold recovery was measured through same CIL cyanidation leaching process. Table 7 shows the leaching results after the ore was conditioned with surfactant.

TABLE 7

| Surfactant used | Surfactant dosage added (kg/t) | Activated carbon used in CIL leaching | Gold Recovery (%) |
|---|---|---|---|
| none | 0 | carbon 1 | 33.6 |
| Ethomeen T/12 | 1.0 | carbon 1 | 45.3 |
| Ethomeen T/12 | 1.0 | carbon 2 | 53.6 |
| Propomeen T/12 | 1.0 | carbon 1 | 49.8 |
| Propomeen T/12 | 1.0 | carbon 2 | 53.6 |

Example 8

A sample of the same ore and its powder as in Example 7 was used for foaming tests. The foaming tests were done in a 500 mL erlenmeyer flask under constant agitation by a magnetic stirring bar, with air flow of 1 L/min through micro pipette. Water and ore powder were added into the erlenmeyer flask, and gave a slurry with pulp density of 35~40% wt solids. Surfactant or surfactant mixture was added into slurry and the slurry was heated to 70~90° C. Foam would generate from the slurry under constant agitation and air sparging, and bubble out of the flask. The out of the flask foam was collected in a pre-graduated catch tray for a period of 60 minutes from the start of agitation and air sparging, the amount of the foam generated during the test was measured there.

| Surfactant used | Surfactant dosage added (kg/t) | observation | Amount of foam generated |
|---|---|---|---|
| Ethomeen T/12 | 1.0 | Foam was quickly formed and stable | More than 1.0 liter |
| Mixture of 75% Ethomeen T/12 + 25% Prppomeen T/12 | 1.0 | small amount of foaming | <100 mL |
| Mixtures of 50% Ethomeen T/12 + 50% Propomeen T/12 | 1.0 | almost no foaming | <1 mL |
| Propomeen T/12 | 1.0 | almost no foaming | <1 mL |

What is claimed is:

1. A method for recovering a metal from ore or concentrate containing carbonaceous material by cyanidation leaching, the method comprising the following steps:

a) treating the ore or concentrate containing carbonaceous material with at least one cationic surfactant in order to reduce or prevent retention of said metal or a cyanide complex of said metal by said ore or concentrate as a result of the presence of said carbonaceous material in said ore or concentrate, the ore or concentrate after said treating being designated "treated ore or concentrate", and b) cyanidation leaching of the treated ore or concentrate, wherein the cationic surfactant is a saturated or unsaturated alkyl amine or derivative thereof, wherein the alkyl amine is selected from the group consisting of primary alkyl amines, secondary alkyl amines, tertiary alkyl amines and alkyl polyamines, and wherein the alkyl amine has an alkyl chain length of 14 to 40.

2. The method of claim 1, further comprising a step of adding a cyanide-containing solution to the ore or concentrate.

3. The method of claim 1, further comprising a step of roasting the ore or concentrate prior to the treating step.

4. The method of claim 1, wherein the ore or concentrate is in an aqueous ore slurry with particle size 80% passing 30 mesh or finer and a pulp density of 5% to 80%.

5. The method of claim 1, further comprising a step of oxidizing the ore or concentrate prior to the treating step.

6. The method of claim 1, wherein the alkyl amine is animal based or vegetable based fatty alkyl amine.

7. The method of claim 1, wherein the alkyl amine is alkoxylated.

8. The method of claim 1, wherein the cationic surfactant is selected from the group consisting of a salt of the alkyl amine, an alkyl amine derivative, and combinations thereof.

9. The method of claim 1, wherein the cationic surfactant is an alkyl quaternary ammonium salt.

10. The method of claim 1, wherein the cationic surfactant is an alkyl amine oxide.

11. The method of claim 1, wherein the cationic surfactant is selected from the group consisting of an alkyl amide, amidoamine, imidazoline, and combinations thereof.

12. The method of claim 1, wherein the ore or concentrate is treated with the cationic surfactant and at least one other surfactant selected from the group consisting of a cationic surfactant different from the cationic surfactant, an anionic surfactant, a non-ionic surfactant, an amphoteric surfactant, and combinations thereof.

13. The method of claim 1, further comprising a step of adding a defoamer to the ore or concentrate prior to the step of cyanidation leaching.

14. A method for recovering a metal from ore or concentrate containing carbonaceous material by cyanidation leaching, the method comprising the following steps:

a) treating the ore or concentrate containing carbonaceous material with at least one cationic surfactant in order to reduce or prevent retention of said metal or a cyanide complex of said metal by said ore or concentrate as a result of the presence of said carbonaceous material in said ore or concentrate, the ore or concentrate after said treating being designated "treated ore or concentrate", and b) cyanidation leaching of the treated ore or concentrate, wherein the cationic surfactant is a saturated or unsaturated alkyl amine or derivative thereof, wherein the alkyl amine is selected from the group consisting of primary alkyl amines, secondary alkyl amines, and tertiary alkyl amines, and wherein the alkyl amine has an alkyl chain length of 14 to 40.

* * * * *